United States Patent [19]

Lawless

[11] Patent Number: 5,032,187

[45] Date of Patent: Jul. 16, 1991

[54] VENETIAN BLIND CLEANING SYSTEM

[76] Inventor: Shirley A. Lawless, 145 Madison Avenue, Toronto, Ontario, Canada, M5R 2S6

[21] Appl. No.: 360,832

[22] Filed: Jun. 2, 1989

[30] Foreign Application Priority Data

Jun. 3, 1988 [CA] Canada ..... 568552

[51] Int. Cl.[5] ..... B08B 1/02; B08B 3/00

[52] U.S. Cl. ..... 134/32; 15/77; 15/114; 15/302; 15/303; 15/306.1; 134/10; 134/40; 134/36; 134/76; 134/130; 134/144; 134/184

[58] Field of Search ..... 15/77, 114, 306, 303, 15/302; 134/15, 23, 24, 32, 76, 184, 36, 144, 10, 40, 130

[56] References Cited

U.S. PATENT DOCUMENTS

| | | | |
|---|---|---|---|
| 2,273,514 | 2/1942 | Chamberlin | 15/77 |
| 2,279,691 | 4/1942 | Long et al. | 15/77 |
| 2,313,606 | 3/1943 | Webb et al. | 15/77 |
| 2,318,884 | 5/1943 | O'Kelley | 15/77 |
| 2,472,155 | 6/1949 | Gaino | 15/77 |
| 2,633,437 | 3/1953 | Det Jen | 134/130 |
| 2,682,676 | 7/1954 | Franchi | 15/77 |
| 3,643,277 | 2/1972 | Durst | 15/77 |
| 4,730,360 | 3/1988 | Brugelman | 15/77 |
| 4,817,646 | 4/1989 | Brooks | 134/10 |

*Primary Examiner*—Curtis R. Davis

*Attorney, Agent, or Firm*—Hoffman, Wasson & Gitler

[57] ABSTRACT

In a cleaning system for cleaning venetian blinds, the blinds are stretched with their slats extending vertically on a carrier belt that is mounted to rotate about longitudinally separated drive and idler assemblies. One run of the carrier belt forms a station for loading and unloading of the blinds, and the other run of the carrier belt passes through successively arranged chambers in which both sides of the blinds to be cleaned are sprayed with washing liquid followed by various rinse solutions, whereafter the blind is passed through a drying chamber in which hot air is blown to effect drying. The vertical arrangement of the slats of the blind enable the washing and rinse liquids to drain rapidly and substantially completely so that the energy required for drying is reduced. The blinds are held upon the carrier belt under tension which has the effect of producing a slight separation between the slats of the venetian blind when in the closed position, and also prevents shrinkage of the venetian blind ladders as a result of heating during drying.

15 Claims, 5 Drawing Sheets

VENETIAN BLIND CLEANING SYSTEM

BACKGROUND OF THE INVENTION (a) Field of the Invention

This invention relates to a new or improved cleaning system for cleaning structures such as removable screens, blinds, light diffusers and the like, and is specifically directed to a system for cleaning venetian blinds.

(b) Description of the Prior Art

Structures such as window screens, light diffusers and venetian blinds in use become soiled with atmospheric dirt, dust, and deposited residues, e.g., of smoke, oils and the like. Thus these structures require periodic cleaning, which has hitherto usually been done by hand. Attempts have been made to provide automated cleaning systems for venetian blinds, but none of these has been completely successful. One approach is shown in U.S. Pat. No. 2,313,606 Webb et al. which discloses a system in which the venetian blinds have to be disassembled and the slats cleaned individually by being passed serially through a cleaning tank. Obviously considerable labour is involved in first disassembling and later reassembling the venetian blind structure.

U.S. Pat. No. 2,279,691 Long et al. discloses a means for cleaning venetian blinds without disassembling them. In this patent the blinds are suspended vertically on a frame in their normal operating attitude, i.e., with the slats horizontal. The frame moves on an oval track through a cleaning station wherein sprays and brushes are applied, and a drying station. An optional mechanism for reversing the slats is provided so that all parts of their surfaces can be cleaned. While the apparatus disclosed in the Long et al. patent has the advantage that cleaning is done without disassembly of the venetian blind, the system is not particularly effective, and has not found favour commercially.

SUMMARY OF THE INVENTION

The present invention provides a new or improved cleaning system which is believed to overcome certain of the drawbacks inherent in the prior art, and provide a practical and economical means for cleaning various structures and in particular venetian blinds.

The present invention provides apparatus for cleaning slatted light-diffusing structures such as venetian blinds, comprising: an endless foraminous carrier belt which passes around spaced idler and drive assemblies arranged to rotate about parallel at least generally upright axes, said carrier belt having means for supporting thereon at least one of said slatted structures to be cleaned, such that said slatted structure is held in taut condition with the slats thereof extending generally vertically, said carrier belt defining between the idler and drive assemblies a first run that provides a loading-/unloading location for attachment of said slatted structures to the belt and their subsequent removal, and a second run which passes successively through wash, rinse, and drying stations, such that slatted structures attached to said belt at the loading location are carried sequentially through said stations as said belt is advanced by said drive assembly.

From another aspect the invention provides a method for cleaning slatted light-diffusing structures such as venetian blinds comprising: providing a foraminous carrier belt arranged to rotate in an endless loop about horizontally spaced drive and idler assemblies to define first and second runs, said second run of the carrier belt passing successively through a washing chamber, one or more rinse chambers, and a drying chamber; attaching a slatted structure to the first run of said belt, said slatted structure being mounted with the slats thereof extending generally vertically, and being under tension to maintain separation between the said slats; rotating said drive assembly to move said belt and advance the slatted structure thereon through said chambers; applying washing liquids under pressure through spray nozzles against both sides of the slatted structure in said washing chamber; applying rinse liquid against both sides of said slatted structure in said one or more rinse chamber; and applying hot air against both sides of said slatted structure in said drying chamber to dry said slatted structure; and maintaining said slatted structure under tension after it exits from the drying chamber until it has cooled sufficiently to prevent significant shrinkage thereof, and detaching said cleaned slatted structure when it returns to the first run of the belt.

Because of the orientation in which the venetian blinds are mounted on the carrier belt, drainage of cleaning and rinsing fluids is very much improved as compared to systems wherein the slats are horizontal, and accordingly the entire cleaning system and particularly the drying stage thereof is made more efficient.

Mounting the venetian blinds on the carrier belt under tension has two significant advantages. Firstly, if before mounting the slats are deployed at a three-quarters closed position, upon mounting and applying tension to the venetian blind, the slats are moved to the fully closed position and at the same time separated slightly, this being possible by stretching of the cords and ladders of the blinds. In this way, when installed on the carrier belt the complete area of both surfaces of each slat is exposed for cleaning, i.e., the conventional overlap which exists between the slats when the blind is closed is eliminated. The second advantage is that shrinkage of the cords and ladders is avoided. Without this provision, where the venetian blinds pass through a hot wash and drying process, shrinkage of several inches in the effective length of the blind would typically be experienced.

The carrier belt may conveniently be formed from a series of spaced vertical stainless steel rods of a suitable length (i.e., corresponding to the width of the largest structure which the apparatus is to clean), the ends of the rods being received in brackets attached to a pair of stainless steel cables formed in loops that move in spaced horizontal planes and pass over drive and idler sprockets. The sprockets may be provided with notches to receive and drivingly engage the brackets holding the ends of the rods. Suitable brackets are provided for engaging the rods and attaching thereto the structure to be cleaned, e.g., the head rail of a venetian blind. Spring loaded attachment means are provided for engaging the bottom rail and attaching this under tension to the rods of the carrier belt. Although of substantial height and length, the cleaning apparatus can be of quite narrow width, since the two runs of the carrier belt need not be spaced more than about two feet apart. One run constitutes a station for loading the blinds and subsequently unloading them after cleaning, and the other run passes through the wash, rinse, and drying stations. These stations are preferably formed as a series of adjacent vertically elongated chambers formed in sheet metal, a pair of opposed walls of each chamber defining a vertically elongated slot through which the moving carrier belt (and any structure mounted thereon for cleaning) can pass, suitable baffle means being provided in each slot to minimize leakage of fluid between the chambers or to atmosphere. Preferably the stations include a wash chamber, a pre-rinse chamber, a rinse chamber, and a final rinse chamber, each of which includes pipe work and a system of nozzles to apply liquid under high pressure against both sides of the object to be cleaned, the bottom end of each chamber forming a sump to collect the sprayed liquid for reuse or for disposal. The drying chamber includes a series of air nozzles through which streams of hot air can be blown onto the object to be cleaned.

BRIEF DESCRIPTION OF THE DRAWINGS

The invention will further be described, by way of example only, with reference to the accompanying drawings wherein.

DESCRIPTION OF THE PREFERRED EMBODIMENTS

The cleaning apparatus comprises a frame structure 11 having a base 12 and a longitudinally extending horizontal head beam 13.

Figure 1:
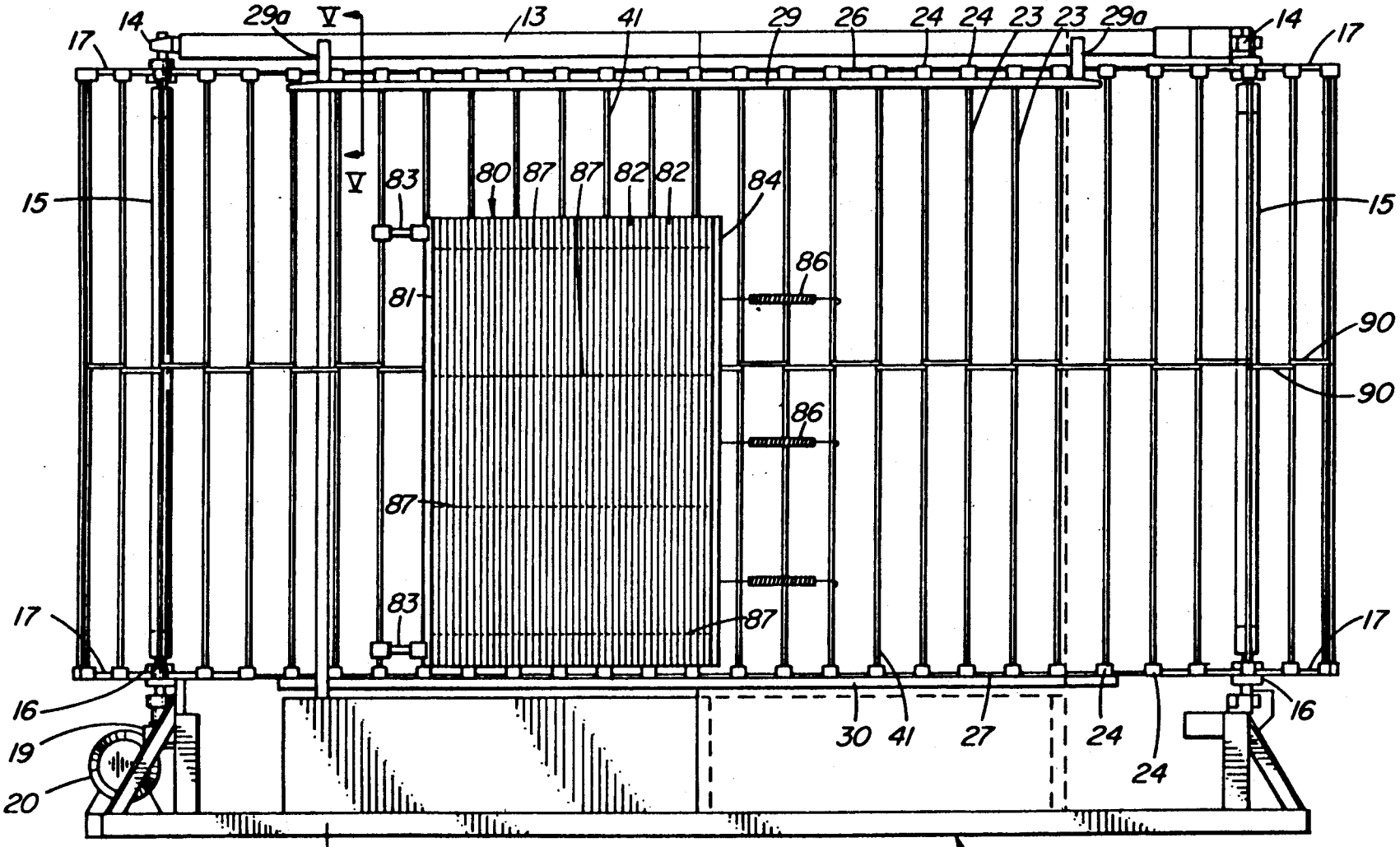
FIG. 1 is a somewhat schematic front elevational view of the cleaning apparatus.

At each of the head beam is a bearing structure 14 which supports the upper end of a vertical shaft 15 the lower end of which is carried in a bearing structure 16 in the base. The shafts 15 are thus mounted to rotate about vertical axes, and each shaft carries at its upper and lower end a sprocket wheel 17 that is keyed to rotate with it, each sprocket wheel having on the periphery thereof equiangularly spaced recesses 18. The shaft 15 that is to the left as seen in FIG. 1 is a drive shaft and is coupled through a transmission 19 to an electric motor 20 which may be driven to effect rotation of the shaft at a selected speed. The shaft 15 which is to the right as seen in FIG. 1 is an idler shaft.

Figure 2:
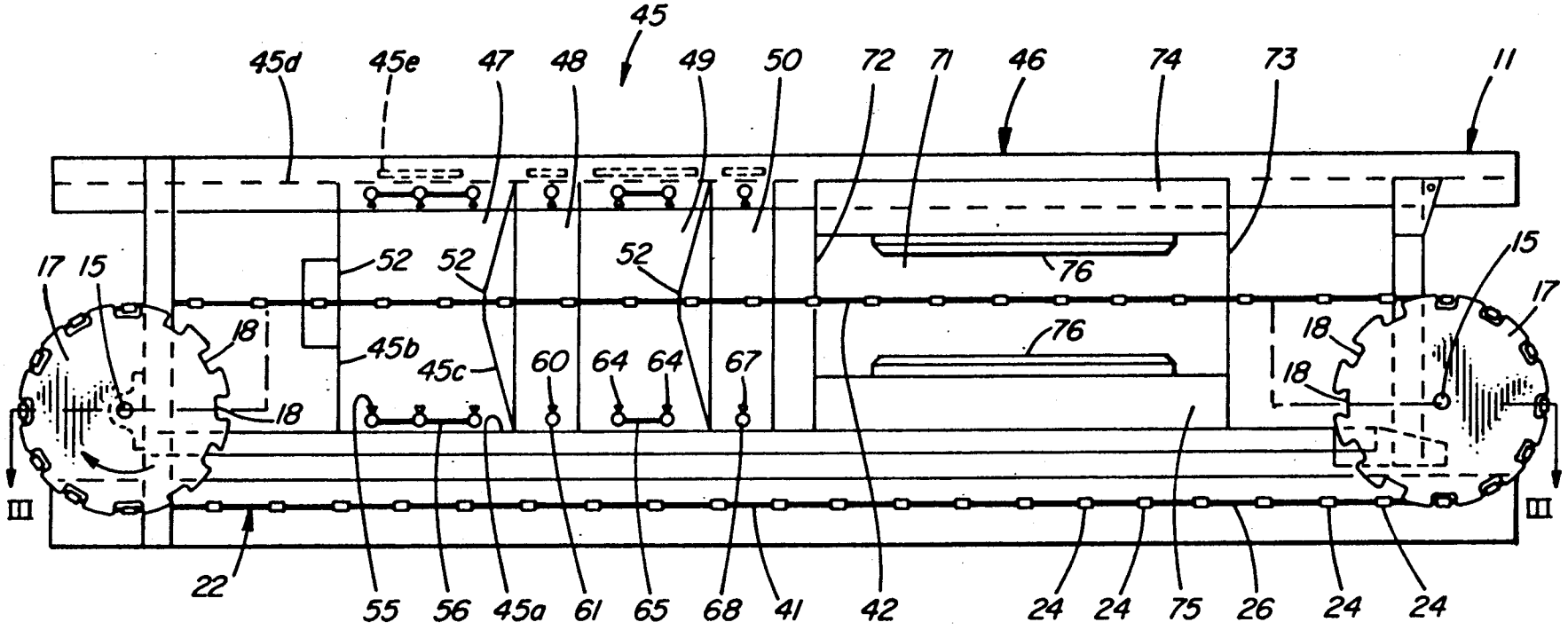
FIG. 2 is a corresponding plan view.

An open structured carrier belt 22 is supported to move on the sprocket wheels 17 and is formed in an endless loop having generally vertically extending first and second runs extending between the opposed pairs of sprocket wheels. As best seen in FIGS. 1 and 2, the carrier belt 22 comprises a series of thin stainless steel rods 23 extending vertically parallel to one another, the opposite ends of each rods being received in a brass bracket 24, and secured thereto by suitable means, such as a grub screw. The brass brackets 24 are in turn attached at spaced intervals to upper and lower endless loops of stainless steel cable 26, 27 which pass around the sprockets 17. The size and spacing of the brackets 24 are such that they are received in the recesses 18 of the sprockets of the drive shaft and form a driving connection therewith so that rotation of the drive shaft will cause the carrier belt 22 to move around the loop defined by the sprocket wheels 17. The sprocket wheels 17 on the idler shaft also interact with the brackets 24 by way of their recesses 18 to provide guidance for the carrier belt 22.

Figure 5:
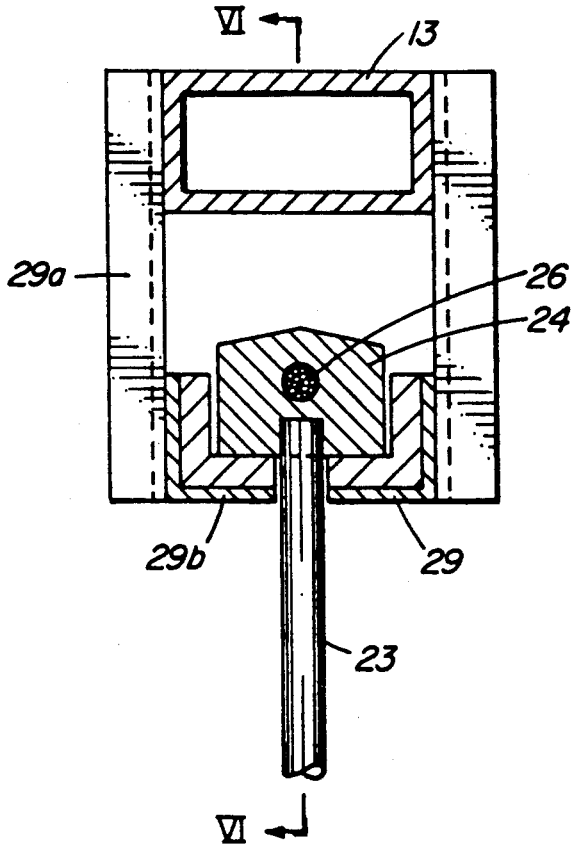
FIG. 5 is an enlarged fragmentary sectional view taken on the line V—V in FIG. 1.
Figure 6:
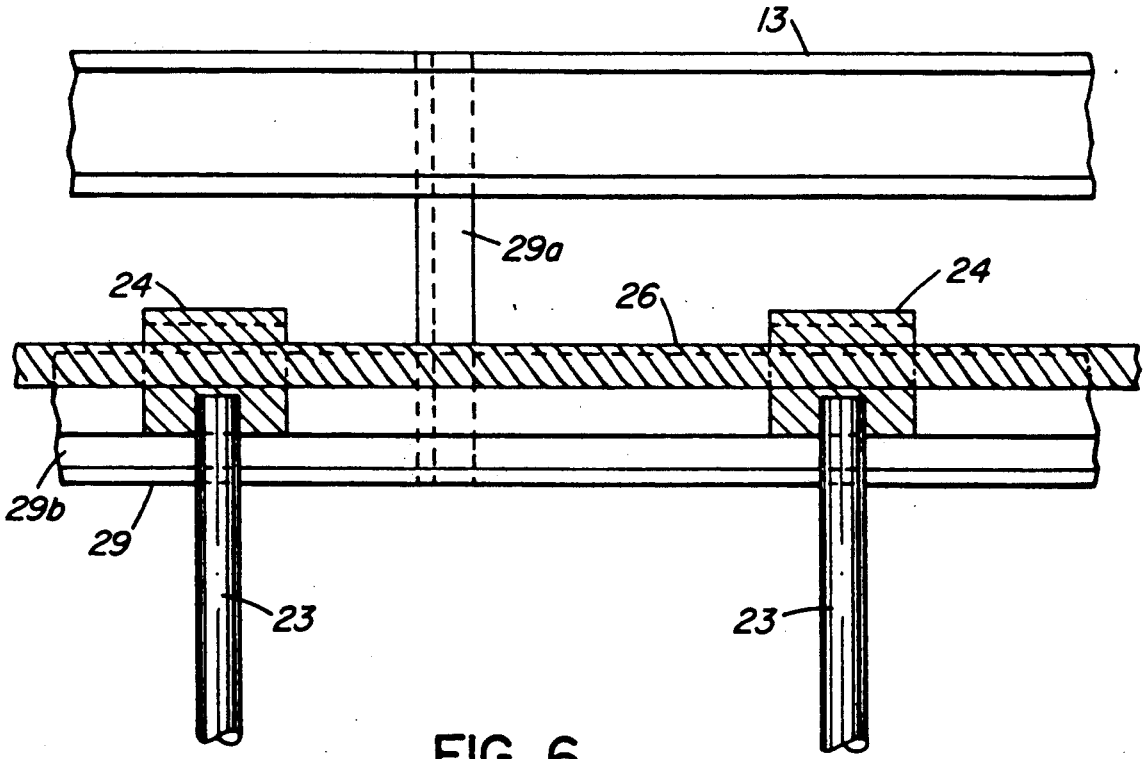
FIG. 6 is a sectional view taken on the line VI—VI in FIG. 5.

As will be seen in FIGS. 1 and 2, the carrier belt therefor defines elongate vertically extending spaced parallel runs which are separated by a distance corresponding to the diameter of the sprocket wheels 17. To prevent sagging of the carrier belt 22 over the extent of these runs, there are arranged guide means in the form of upper and lower channels 29, 30 through which the brackets 24 on the cable loops 27 pass as they move between the drive and idler shaft assemblies. The upper channel 29 is shown in greater detail in FIGS. 5 and 6 and comprises a U-shaped metal channel 29 that is supported from the head beam 13 by a series of vertically extending struts 29A which are welded or otherwise suitably secured to the channel 29 and the head beam 13.

The channel 29 includes a lining 29B of low friction material such as nylon or PTFE to facilitate sliding of the brass brackets 24 therealong.

Figure 3:
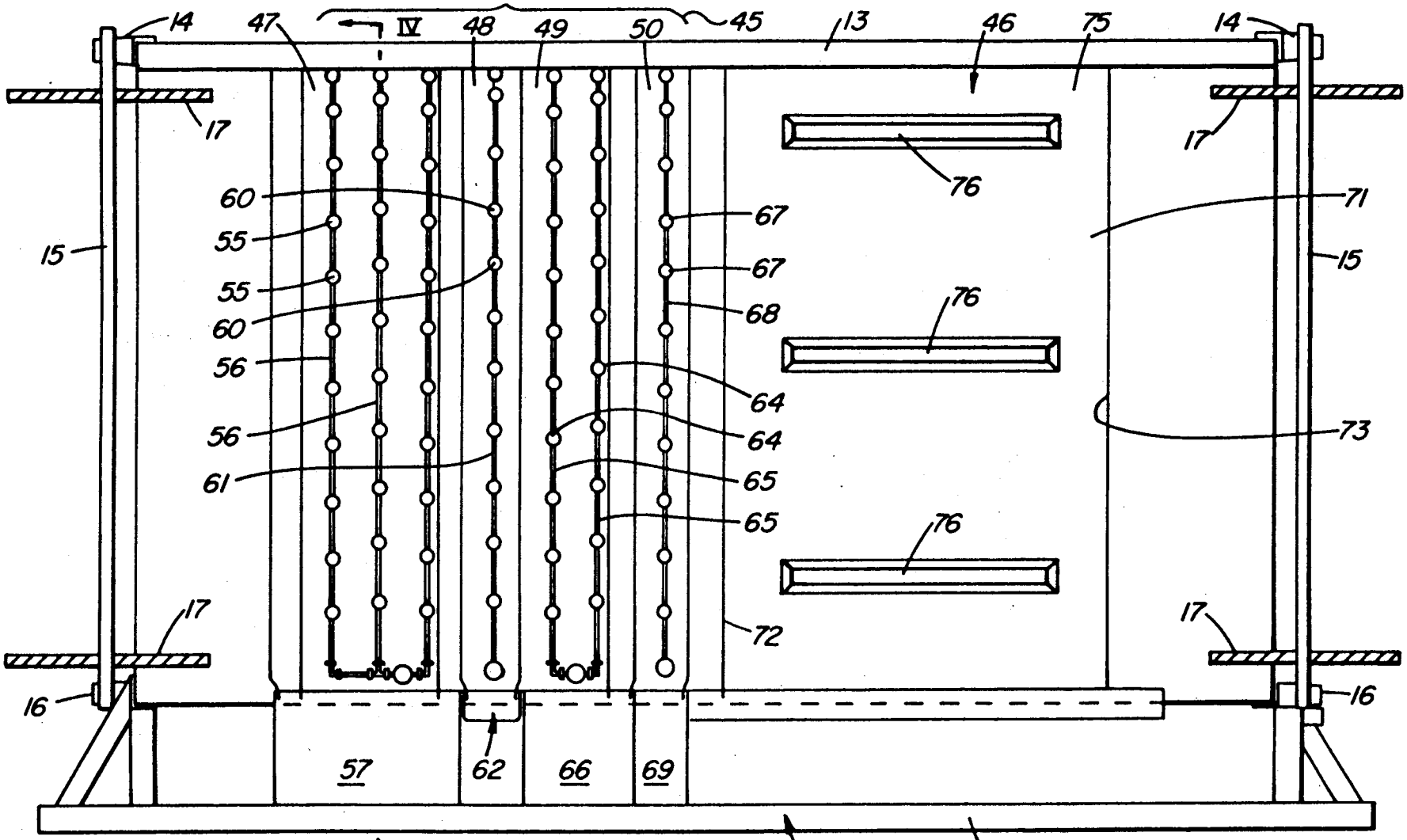
FIG. 3 is a sectional view taken generally on the line III—III in FIG. 2.
Figure 4:
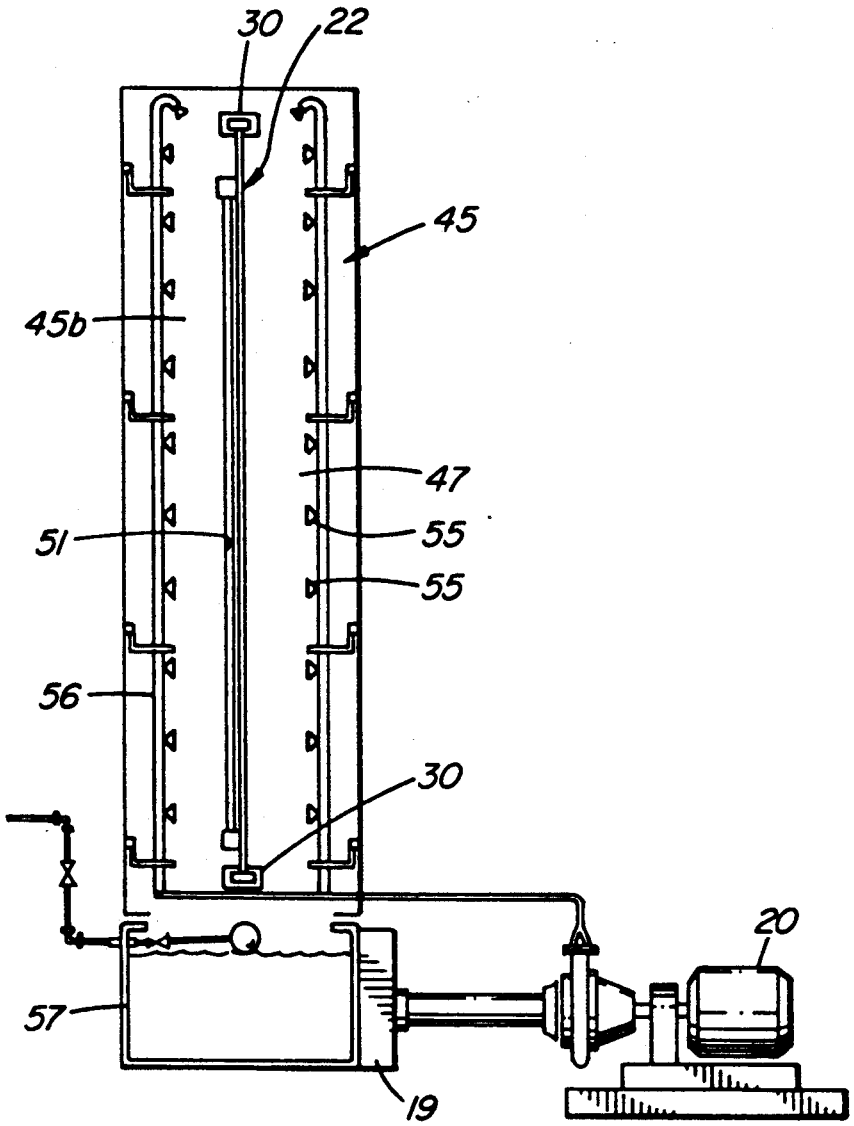
FIG. 4 is a sectional view taken on the line IV—IV in FIG. 3.

The front run 41 of the carrier belt 22 is clear and unobstructed as can be seen from FIG. 1, whereas the rear run 42 passes through the cleaning and drying stations as will now be more fully described in relation to FIGS. 2, 3 and 4. Referring to FIG. 2, the drive shaft 15 is rotated in the direction indicated by the arrow to advance the carrier belt 22 successively through a washing station 45 and a drying station 46. The washing station comprises in succession a wash chamber 47, a short prerinse chamber 48, a longer rinse chamber 49, and a short final rinse chamber 50, these chambers being defined by sheet metal walls which are preferably fabricated in stainless steel. As seen in FIG. 2, the washing station 45 has a continuous lateral wall **45*a*, opposed end walls 45*b*, 45*c*, and a further lateral wall 45*d* provided with a large door 45*e*** which can be opened to provide access to the interior of the chamber.

Centrally in each of the end walls **45*b* and 45*c* there is an elongate vertical slot 51 of a length in excess of the height of the carrier belt 22 and of a width to accommodate passage therethrough of the carrier belt together with a venetian blind or other structure supported on the belt. A baffle arrangement 52 is provided along the edges of the slot 51 to minimize the escape of water or other cleaning fluid from the wash chamber 47**.

Within the wash chamber 47 on each side of the carrier belt 22 there is an array of spray nozzles 55 directed towards the opposite sides of the belt and distributed substantially uniformly over the entire height and length of the chamber 47. The nozzles 55 are adapted to be supplied with wash liquid through a pipe work system 56 from a source such as a tank 57 located at the bottom end of the chamber 47. As seen in FIG. 3, on each side of the carrier belt, the chamber 47 has three vertical rows of the spray nozzles 55.

The three rinse chambers 48, 49 and 50 are constructed in similar manner to the wash chamber 47, but are of different sizes. The pre-rinse chamber 48 is relatively short and has on each side of the carrier belt a single row of vertically spaced nozzles 60 carried on a pipe arrangement 61 which can be supplied with a rinse liquid, e.g., water. A drainage sump 62 collects the rinse liquid after use.

The rinse chamber 49 is of greater length than the chamber 48 and has two longitudinally spaced rows of nozzles 64 spaced vertically on a pipe arrangement 65 on each side of the carrier belt 22. At the bottom of the chamber 49 is a sump 66 which collects rinse water from the chamber for recycling or disposal. The final rinse chamber 50 has on each side of the carrier belt 22 a single row of vertically spaced nozzles 67 carried on a pipe arrangement 68 through which rinse solution can be delivered to the nozzles 67, used rinse solution draining into the sump 69.

As is the case with the wash chamber 47, the rinse chambers 48, 49 and 50 have end walls formed with slots 51 for passage of the carrier belt 22, suitable baffle arrangements 52 being provided as required in these slots. These chambers are also provided with doors corresponding to the door 45e to provide access to their interiors for maintenance and the like.

The drying station 46 likewise comprises a vertically elongated chamber 71 formed by end walls 72, 73, the lateral walls of this chamber being defined by plenums 74, 75 defining channels through which hot air can be delivered to each side of the carrier belt 22 by vertically spaced horizontally elongated slot-type nozzles 76. The plenums 74, 75 are connected to duct work through which hot air can be delivered under pressure to exit through the slot-type nozzles 76.

For cleaning, a venetian blind 80 is attached to the carrier belt 22 as illustrated in FIG. 1 with the slats thereof arranged to extend vertically. The head rail 81 of the venetian blind is attached to clamps 83 to the rods 23 of the belt, the bottom rail 84 being connected to spring loaded fasteners 86 which in turn are connected to one of the rods 23, so that when installed on the carrier belt 22, the venetian blind is placed in tension. To dispose the slats of the venetian blind in proper orientation for cleaning, at the time of mounting, the ladders 87 are set such that the slats of the blind are in a three-quarters closed position. The ladders are made of cord material such as nylon, so that when the venetian blind is placed under tension, they become elongated somewhat and the slats 82 of the blind are turned to the fully closed condition, and are also caused to separate slightly one from the other, through elongation of the ladders 87.

The front run 41 of the carrier belt provides a station for loading and unloading venetian blinds or other objects to be cleaned in relation to the belt. The belt may be operated in a continuous mode, moving at a relatively slow speed, e.g., from 2.5 to 3.5 feet per minute. When a venetian blind has been attached to the carrier belt as shown in FIG. 1, it is carried to the left, around the drive shaft assembly 15, to enter with the belt into the washing chamber 47. In this chamber, the washing solution, suitably hot water with detergents therein, is sprayed forcefully against both surfaces of the venetian blind carried on the belt 22, to provide a cleaning action thereon, this being applied to successive portions of the venetian blind as it is advanced through the wash chamber. From the wash chamber the venetian blind progresses successively through the pre-rinse chamber 48, the rinse chamber 49, and the final rinse chamber 50. In each of these chambers rinse liquid such as hot or cold water is sprayed against opposite sides of the venetian blind to rinse the wash liquid therefrom. The rinse liquid in the pre-rinse chamber 48 will acquire a significant content of the wash liquid, and accordingly is not reused. The rinse liquid used in the larger rinse chamber 49 will remain relatively pure, and can be recycled. The rinse liquid used in the final rinse chamber 50 will preferably include a heat-activated chemical additive which is effective to promote subsequent fast drying of the venetian blind without spotting. It will be appreciated that because of the orientation of the slats 82 of the venetian blind as it passes through the wash and rinse chambers, the liquids used for washing and rinsing will drain very rapidly towards the lower end of these slats so that the residue of liquid carried on the venetian blind will be very small as compared to the quantity that would be retained if the blind were mounted in its normal orientation of use, i.e., with the slats extending horizontally. Because of this orientation the efficiency of the drying process is vastly improved.

After emerging from the downstream end of the drying chamber 71 the venetian blind passes with the carrier belt around the idler shaft assembly 15 and is returned to the front run 41 where it can be removed from the belt at the unloading station. The hot liquids used in the washing process, and in particular the hot air blown onto the venetian blinds in the drying station have a tendency to produce shrinkage of the ladders 87 of the blinds on subsequent cooling. This could be a troublesome problem if unchecked, but is easily overcome in the present cleaning system since the venetian blinds remain under tension on the carrier belt 22 after emerging from the drying station, so that shrinkage of the ladders is prevented.

The stainless steel rods 23 of the carrier belt 22 are relatively thin, e.g., of 0.375 inch diameter, and because of their length are quite flexible. To maintain deflection of these rods within acceptable limits, they are successively interconnected in the mid regions thereof by a series of longitudinally extending links 90 as shown in FIG. 1.

The above description of a preferred embodiment is given by way of illustration and not by limitation. It should be understood that the invention is in no sense limited to the specific details of structure or material as disclosed, but rather the details thereof can be varied widely within the limits of the invention and the scope of the accompanying claims.

One modification not disclosed in the drawings has been conceived to enable the overall width of the apparatus as seen in end view, e.g. in FIG. 4 to be reduced. It will be understood that the sprockets 17 in the embodiment disclosed are of relatively large diameter, and that accordingly the vertical runs of the belt 22 are spaced relatively far apart as determined by the diameter of the sprockets 17. This spacing, and thus the overall width of the machine, could be reduced by causing the belt 22 to pass over idler rollers or sprockets adjacent to the sprockets 17, these idler rollers being spaced relatively closely together so that the vertical runs of the belt 22 are displaced towards one another.

What I claim as my invention is:

1. Apparatus for cleaning slatted light-diffusing structures, comprising: an endless foraminous carrier belt which forms spaced parallel generally vertical first and second runs, said belt being supported on spaced idler and drive assemblies arranged to rotate about parallel at least generally upright axes, said carrier belt having mounting means for supporting thereon at least one of said slatted structures to be cleaned, said mounting means including tensioning means operative to hold said slatted structure in taut condition with the slats thereof extending generally vertically, said carrier belt in said first run providing a loading/unloading location for attachment of said slatted structures to the belt and their subsequent removal, said second run passing successively through wash, rinse, and drying stations, such that slatted structures attached to said belt at the loading location are carried sequentially through the stations as said belt is advanced by said drive assembly.

2. Apparatus as claimed in claim 1 wherein said stations each comprise a vertically extending enclosed chamber having an opposed pair of walls in each of which is defined a vertically elongated slot dimensioned to accommodate the passage therethrough of the second run of the belt and of a slatted structure carried thereon, baffle means being provided adjacent the edges of said slot to restrict passage of fluids out of the chamber.

3. Apparatus as claimed in claim 2 wherein at said wash station chamber there is an array of wash nozzles distributed on each side of the path of movement of said belt therethrough, said wash nozzles being connected through pipework to a supply of high pressure wash liquid to deliver such wash liquid over the entire area of both sides of a slotted structure carried on said belt, the lower end of said wash chamber comprising a sump to collect used wash liquid for recycling.

4. Apparatus as claimed in claim 3 wherein said rinse station comprises at least one rinse chamber provided with a series of nozzles to deliver rinse liquid to both sides of a slatted structure carried therethrough on said belt.

5. Apparatus as claimed in claim 3 wherein said rinse station includes pre-rinse, rinse, and final rinse chambers each provided with a series of nozzles positioned to deliver rinse liquid to both sides of a slotted structure carried on said belts.

6. Apparatus as claimed in claim 5 wherein means are provided to include in the liquid used in the final rinse chamber a chemical additive to enhance the subsequent drying action.

7. Apparatus as claimed in claim 4 wherein the drying station comprises a substantially enclosed chamber having horizontally elongated nozzles in the opposite lateral sides thereof, and means for supplying hot air for delivery through said nozzles to opposite sides of a slatted structure carried on said belt.

8. Apparatus according to claim 1 wherein said carrier belt comprises two vertically spaced closed loops of flexible cable, and a series of elongate metal rods each spanning the distance between said loops and attached at opposite ends to respective ones of said loops, so that the rods extend generally vertically therebetween, said tensioning means comprising springs adapted to be connected in tension between an end rail of the slatted structure and one of said metal rods.

9. Apparatus according to claim 8 wherein said cables are of stainless steel and carry brackets in which the ends of the rods of releasably secured.

10. Apparatus according to claim 8 wherein said rods are of stainless steel, and each is braced to the two rods immediately adjacent thereto in its midsection to prevent excessive deflection thereof.

11. Apparatus according to claim 10 wherein each of said drive and idler assemblies comprise a vertically extending shaft rotatably mounted in the frame and carrying spaced sprocket means fixed to rotate with the shaft, said sprocket means having in the peripheral areas thereof a series of uniformly spaced recesses adapted to receive the brackets in which the ends of the rods are secured, driving of the carrier belt being effected by interengagement of these recesses with the brackets.

12. A method for cleaning slatted light-diffusing structures comprising:

providing a foraminous carrier belt arranged to rotate in an endless loop about horizontally spaced drive and idler assemblies to define first and second runs, said second run of the carrier belt passing successively through a washing chamber, one or more rinse chambers, and a drying chamber;

attaching a slatted structure to the first run of said belt, said slatted structure being mounted with the slats thereof extending generally vertically, and being under tension to maintain separation between the said slats;

rotating said drive assembly to move said belt and advance the slatted structure thereon through said chambers;

applying washing liquids under pressure through spray nozzles against both sides of the slatted structure in said washing chamber;

applying rinse liquid against both sides of said slatted structure in said one or more rinse chamber; and applying hot air against both sides of said slatted structure in said drying chamber to dry said slatted structure; and maintaining said slatted structure under tension after it exits from the drying chamber until it has cooled sufficiently to prevent significant shrinkage thereof, and detaching said cleaned slatted structure when it returns to the first run of the belt.

13. The method of claim 12 wherein a heat activated chemical is added to the rinse water in the final rinse chamber.

14. Apparatus according to claim 1 wherein said tensioning means comprises springs that are adapted to be connected in tension between an end rail of the slatted structure and a mounting location on said belt.

15. Apparatus as claimed in claim 14 wherein said springs are of strength sufficient to maintain the slats of said slatted structure in generally coplanar spaced apart relation.

* * * * *